US006786362B2

(12) United States Patent
Sisk

(10) Patent No.: US 6,786,362 B2
(45) Date of Patent: Sep. 7, 2004

(54) SWING-AWAY HOPPER TEE

(75) Inventor: David E. Sisk, Bonne Terre, MO (US)

(73) Assignee: Sure Seal, Inc., Mineral Point, MO (US)

( * ) Notice: Subject to any disclaimer, the term of this patent is extended or adjusted under 35 U.S.C. 154(b) by 144 days.

(21) Appl. No.: 10/298,305

(22) Filed: Nov. 18, 2002

(65) Prior Publication Data

US 2004/0094954 A1 May 20, 2004

(51) Int. Cl.[7] ..... F16L 39/00

(52) U.S. Cl. ..... 222/181.1; 222/460; 222/531; 251/143

(58) Field of Search ..... 222/181.1, 181.2, 222/181.3, 460, 531; 251/143, 144, 291, 292; 366/76.92

(56) References Cited

U.S. PATENT DOCUMENTS 3,602,400 A * 8/1971 Cooke ..... 222/185.1
4,418,844 A * 12/1983 Hehl ..... 222/162
4,848,396 A 7/1989 Sisk
5,387,015 A 2/1995 Sisk
5,617,907 A * 4/1997 Sisk ..... 141/340
5,842,681 A 12/1998 Sisk
6,234,890 B1 * 5/2001 Passoke et al. ..... 452/30
6,582,160 B2 * 6/2003 Campbell et al. ..... 406/131
6,607,177 B2 * 8/2003 Burian et al. ..... 251/144
6,616,123 B2 * 9/2003 Burian et al. ..... 251/144

* cited by examiner

*Primary Examiner*—Kenneth Bomberg
(74) *Attorney, Agent, or Firm*—Paul M. Denk

(57) ABSTRACT

A swing-away hopper tee assembly comprises a mounting frame, tee assembly, and a valve assembly. The hopper tee assembly is removably mountable to a flange at the discharge end of a hopper. The mounting frame includes a bottom wall, a top wall spaced from the bottom wall, and an outer wall extending between the top and bottom walls to define a channel sized and shaped to receive the hopper flange. The flange includes at least one opening, and a corresponding opening is formed in the channel. A fastener extends through the aligned flange and channel openings to removably secure the mounting frame to the hopper.

9 Claims, 6 Drawing Sheets

SWING-AWAY HOPPER TEE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates generally to hopper tees and, more specifically, to a low-profile, swing-away hopper tee and valve assembly.

Hoppers or tank trailers commonly are used to transport bulk commodities such as industrial and food products. When the hopper or tank trailer reaches its destination, the bulk commodity is unloaded. Typically this is done by pneumatically unloading the bulk commodity from the hopper into a clean and sanitary pipe line. For this purpose, hopper tees are mounted to the discharge outlet of the hopper truck. The hopper tee conventionally has a vertical section and a horizontal section forming the tee configuration. To transfer the bulk commodity, the material is moved out of the hopper by gravity flow or air pressure vibration into the vertical section of the hopper tee. The clean pipe discharge pipe is connected to the horizontal section of the tee. Pneumatic conveyance of the material through the pipe is accomplished by establishing a pressure differential in the pipe.

Prior art hopper tees have been constructed by welding vertical and horizontal pipe sections together. Such tees are prone to excessive wear and failure. I addressed such problems in my prior U.S. Pat. No. 4,848,396 which discloses a cast hopper tee designed to provide a smooth and uninterrupted internal transitional surface; and in my prior U.S. Pat. No. 5,387,015 which provides for a hopper tee having an elliptical opening and a pair of wear saddles creating double wall thicknesses at the transition areas between the vertical and horizontal pipes.

Although my prior hopper tees function well for their intended purposes, there are several problems associated with the prior hopper tees. The prior hopper tees are formed as a complete, one piece unit having a vertical section and a horizontal section. The hopper tees are designed to fit on the bottom of pneumatic tank trailers. The valve and the hopper tee are bolted to a flange. To remove the hopper tee the bottom line piping and the valve must be removed. The user must use wrenches to unbolt 4, 6 or 8 bolts that hold the hopper tee, the valve and the line to the bottom of the hopper. An excessive amount of time is used to perform such a task.

Further, when the user is washing the trailer and changing product, for example, from a load of black plastic pellets to white plastic pellets, just one black plastic pellet can contaminate a complete bin of white plastic pellets. Likewise, one kind of residual polymer can contaminate an entire load of different polymer. To ensure that there are no contaminants left in the hopper tee, valve or line, the entire assembly must be unbolted and removed. The area is cleaned and then reassembled. This is time consuming and costly.

Since conventional hopper tees are constructed as one piece and must be unbolted to be removed from the line, it would be advantageous to have a hopper tee that can be opened without removal of bolts to allow access to the interior of the tee for complete emptying and cleaning.

Furthermore, some prior art hopper tees do not afford proper ground clearance. Ground clearance has been a problem in the tank industry for years. There are established heights, widths and lengths that tanks must meet by Department of Transportation (DOT) specifications. When the hauler is handling light density products, such as plastic pellets, he needs a larger cubic foot capacity to haul a maximum payload and make hauling such products economically feasible. To increase the cubic foot capacity and still stay within DOT height, width and length standards, the bottom of the hopper needs to be lowered to increase capacity. However, the bottom of the hopper must be designed with angled walls (angle of repose) that funnel down to the hopper tee to allow for emptying. For many dry bulk products the angle of repose needs to be approximately 45° to obtain the maximum cubic foot capacity while remaining within the mandated dimensions. Since the hopper tee is mounted below the tank it is obvious that ground clearance problems can arise. For example, when crossing railroad tracks or other uneven surfaces, every inch of ground clearance is important. In the past, tank manufacturers have tried a 30° angle of repose. However, such hoppers, because of their lesser incline, do not unload well. Some manufacturers have used a hopper having a 45° angle of repose down to the aeration devices and then change the angle to 30° which gains a few inches in ground clearance.

In my U.S. Pat. No. 5,842,681, which is incorporated herein by reference, I disclose a swing-away hopper tee which solves may of the above noted problems. The hopper tee disclosed in the above noted patent includes a mounting frame, a butterfly valve and housing assembly, and a tee assembly. The butterfly valve is mounted between the mounting frame and the tee assembly. The tee assembly is pivotally connected to the mounting frame to be able to swing away from the mounting frame. A camming lock assembly is provided to hold the tee assembly in a raised position, and to allow the tee assembly to swing away from the housing.

The mounting frame of the swing-away hopper tee disclosed my last noted patent is fixedly and permanently mounted to the discharge end of the hopper. Although the swing-away hopper tee works extremely well for its intended purposes, it would be desirable to provide a swing-away hopper tee in which the mounting frame can be easily mounted to the discharge end of the hopper and which can be easily dismounted from the discharge end of the hopper for more thorough cleaning or for replacement, when and if necessary.

BRIEF SUMMARY OF THE INVENTION

In accordance with the invention, generally stated, a swing-away hopper tee assembly comprises a mounting frame, tee assembly, and a valve assembly. The hopper tee assembly is removably mountable to a flange at the discharge end of a hopper. To removably mount the hopper tee assembly to the hopper flange, the mounting frame includes a bottom wall, a top wall spaced from the bottom wall, and an outer wall extending between the top and bottom walls to define a channel sized and shaped to receive the hopper flange. The flange includes at least one opening, and a corresponding opening is formed in said channel. A fastener extends through the aligned flange and channel openings to removably secure the mounting frame to the hopper. Preferably, the channel opening is formed in the mounting frame top wall. The mounting frame bottom wall is then sized to expose the flange opening so that the fastener can pass through the flange opening into the channel opening.

Additionally, the fastener is an alignment pin which is used to align the position of the valve assembly between the mounting frame and the tee assembly.

The hopper tee assembly is mounted to the flange simply by sliding the mounting frame channel over the hopper flange, aligning the mounting frame hole with the flange hole, and securing said pin in place in said holes.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
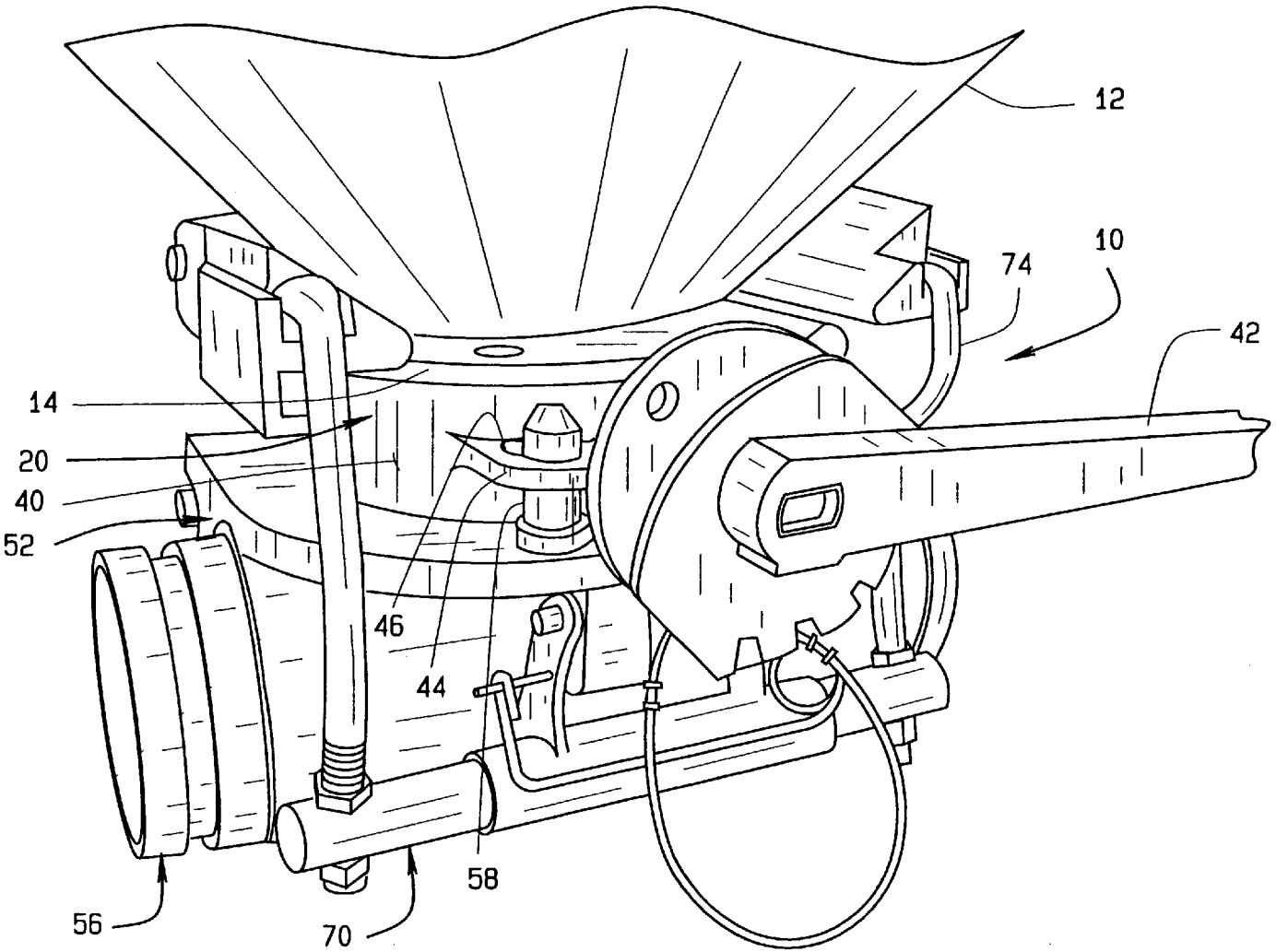
FIG. 1 is a front perspective view of a swing-away hopper tee assembly of the present invention mounted to the discharge end of a hopper.

The following detailed description illustrates the invention by way of example and not by way of limitation. This description will clearly enable one skilled in the art to make and use the invention, and describes what I presently believe to be the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

An illustrative embodiment of a swing-away hopper tee assembly 10 of the present invention is shown in the drawings. The swing-away hopper tee, as discussed below, is removably mounted to the discharge end of a hopper 12, having a flange 14 at its discharge end. The flange 14 (best seen in FIGS. 3 and 4) extends radially from, the surface (or center) of the hopper and includes at least a pair of bolt holes 16.

The hopper tee assembly 10 has three major components, a mounting frame 18, a butterfly valve assembly 20, and a tee assembly 22. As discussed below, and in more detail in my U.S. Pat. No. 5,842,681, the tee assembly 22 is pivotally connected to the mounting frame 18, and the butterfly valve assembly 20 is received between the tee assembly and the mounting frame.

Figure 3:
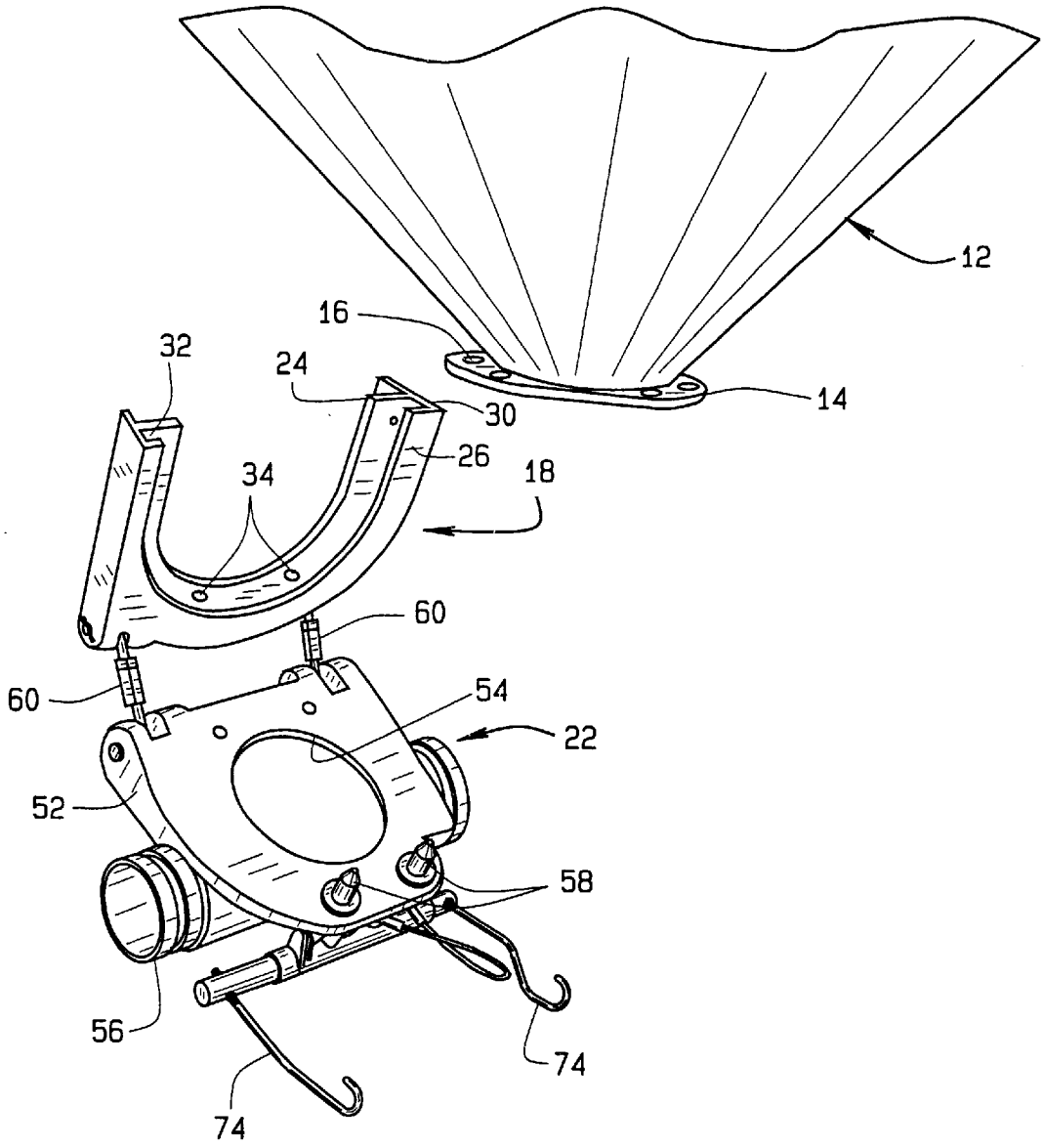
FIG. 3 is an exploded view of the discharge end of the hopper and the swing-away hopper tee assembly, without the butterfly valve.

The mounting frame 18 is generally U-shaped as seen in FIG. 3. It includes an upper wall 24, a lower wall 26, and a side wall 30. The upper and lower walls are spaced apart to define a generally U-shaped channel 32. The side wall 30 extends between the upper and lower walls and forms an outer wall to the channel. Additionally, the wall 30 extends above the upper wall 24. The upper and lower walls 24 and 26 are both generally perpendicular to the side wall 30. The channel 32 is sized to slide over the hopper flange 14. The channel 32 corresponds in shape to the shape of the flange. In as much as the hopper flange is round, the channel 32 is defined by a pair of straight channel sections connected by a curved channel section. The curved channel section has a curvature corresponding to the curvature of the hopper flange 14. If the flange were, for example, square, then the channel 32 would define a squared-off "U". Other shapes could also be used for the flange and the mounting frame channel. For example, the flange and mounting channel could be "V"-shaped.

The mounting frame upper wall 24 extends inwardly from the side wall 30 further than the bottom wall 26. A pair of holes 34 are formed in the curved or back section of the upper wall 24. The holes 34 are sized and positioned to align with the flange openings 16 when the mounting frame is positioned on the flange 14. The mounting frame bottom wall 26 is sized such that the openings 16 in the hopper flange 14 are exposed when the mounting frame is positioned on the flange 14.

A pair of rear positioning pins 36 (FIG. 4) extend through the hopper flange holes 16 into the mounting frame holes 34. The pins 36 each include an elongate shaft 38 and an upper threaded section 40. The pin's threaded section extends through the flange hole 16 to be received in the mounting frame hole 34. If the mounting frame hole 34 is threaded, then the pins 36 are screwed into the mounting frame hole. Alternatively, the threaded end 40 of the pins 36 can pass through both the hopper flange hole 16 and the mounting frame hole 40 and be secured with a nut. The rear positioning pins 36 are sized and so that they will withstand the stresses to which the mounting frame will be subjected to securely hold the mounting frame to the hopper flange 14.

Figure 2:
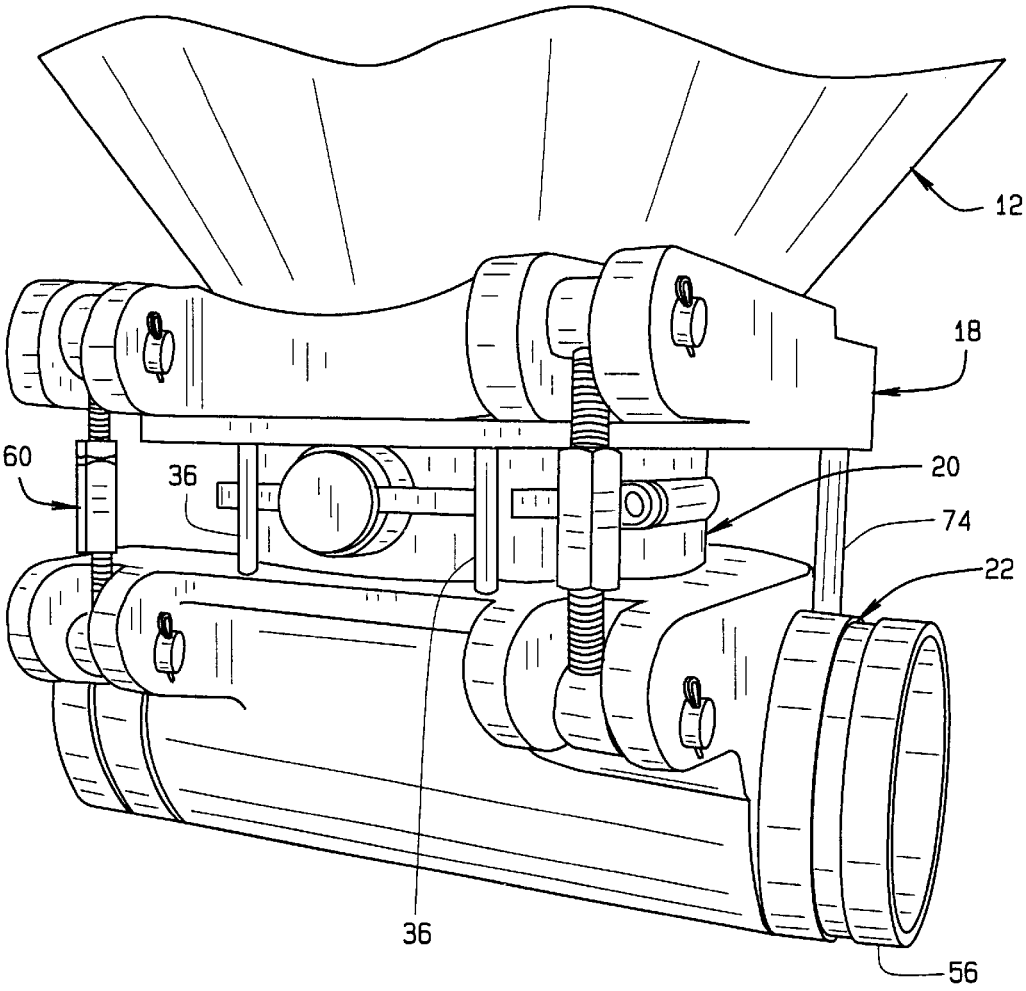
FIG. 2 is a rear perspective view of the swing-away hopper tee assembly, mounted to the discharge end of a hopper.

The butterfly valve assembly 20 is described in my above noted patent, which is incorporated herein by reference Briefly, the valve assembly 20 includes a housing 40 in which the butterfly valve is mounted. An operating lever 42 is pivotally mounted to the housing 40 and is operable, as is known, to open and close the butterfly valve. Additionally, a pair of front ears 44 and a pair of back ears 46 (FIG. 7) extend from the valve housing 40. The ears 44 and 46 each include a hole or slot 48 and 50, respectively. When the tee assembly 10 is closed, as seen in FIGS. 1 and 2, the rear slots 50 receive the rear positioning pins 36. As can be appreciated, the butterfly valve assembly 20 is held in place relative to the mounting frame 18 and the tee assembly 22 by means of the rear and front positioning pins 36 and 58.

The tee assembly 22 includes a plate 52 having an opening 54 therein. The opening 54 is sized and positioned to align with the discharge opening in the bottom of the hopper 12. A tube 56 extends from the bottom of the plate 52. The opening 54 opens into the tube 56 to place the hopper discharge opening in communication with the tube 56 when the butterfly valve is opened. A pair of front positioning pins 58 extend upwardly from the front of the plate. The front positioning pins 58 are sized to extend upwardly to pass through the openings 48 in the butterfly valve housing ears 44. Hence, the butterfly valve assembly will be held in place by the interaction of the ears 44 and 46 of the valve assembly 20 with the front and back pins 58 and 36 of the tee assembly and mounting frame, respectively.

To pivotally connect the tee assembly 22 to the mounting frame 18, the hopper tee assembly 10 includes a connecting rod assembly 60 which is pivotally connected at its opposite ends to the back of the tee assembly plate 52 and the mounting frame 18. The rod assembly 60 is disclosed in my above noted U.S. Pat. No. 5,842,681, which is incorporated herein by reference.

Figure 4:
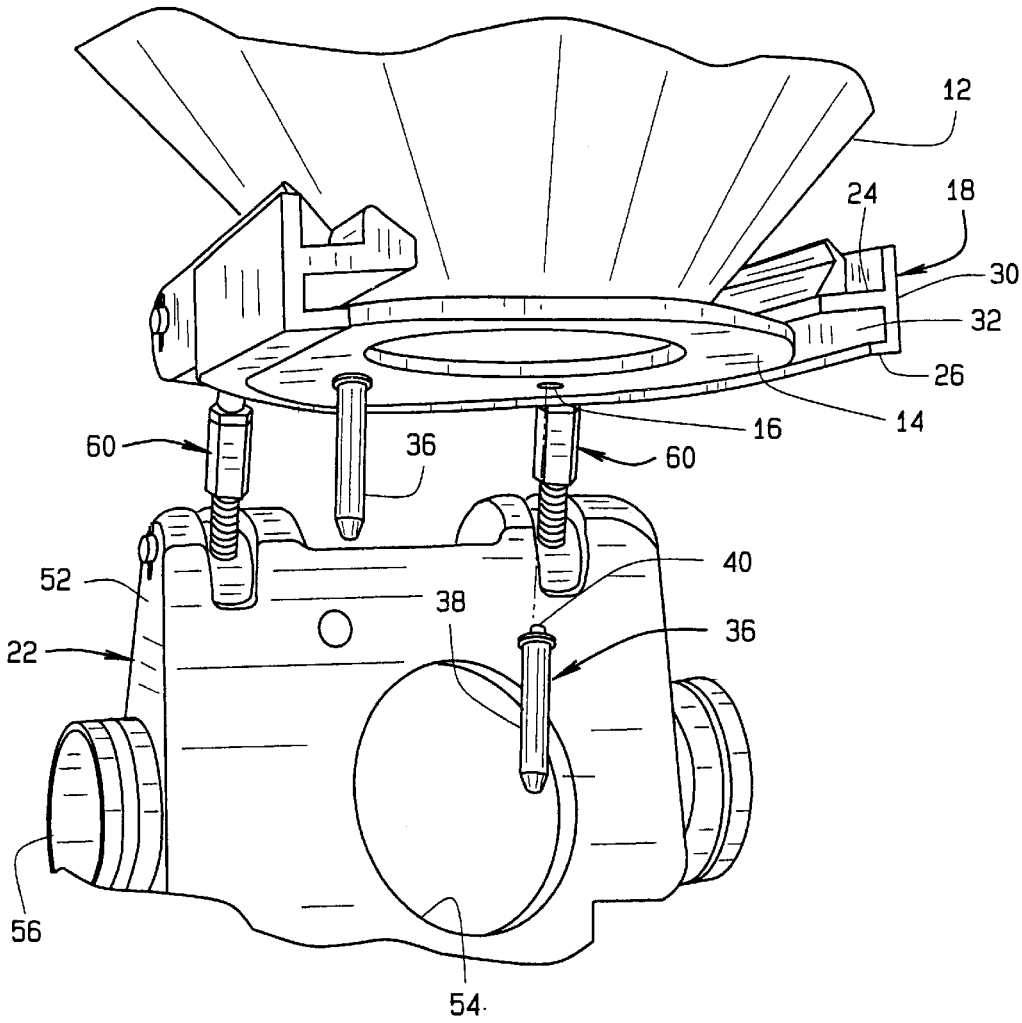
FIG. 4 is a bottom exploded perspective view showing mounting of the hopper tee mounting frame to the flange of the hopper.
Figure 5:
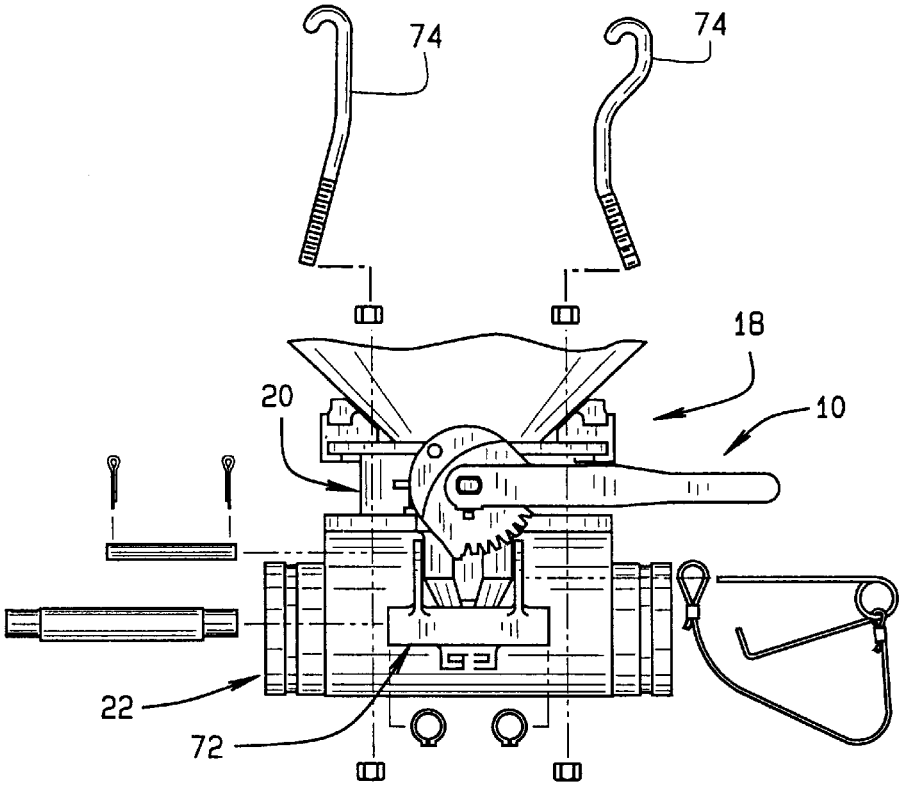
FIG. 5 is a partially exploded front plan view of the swing-away hopper tee assembly mounted to the hopper.
Figure 6:
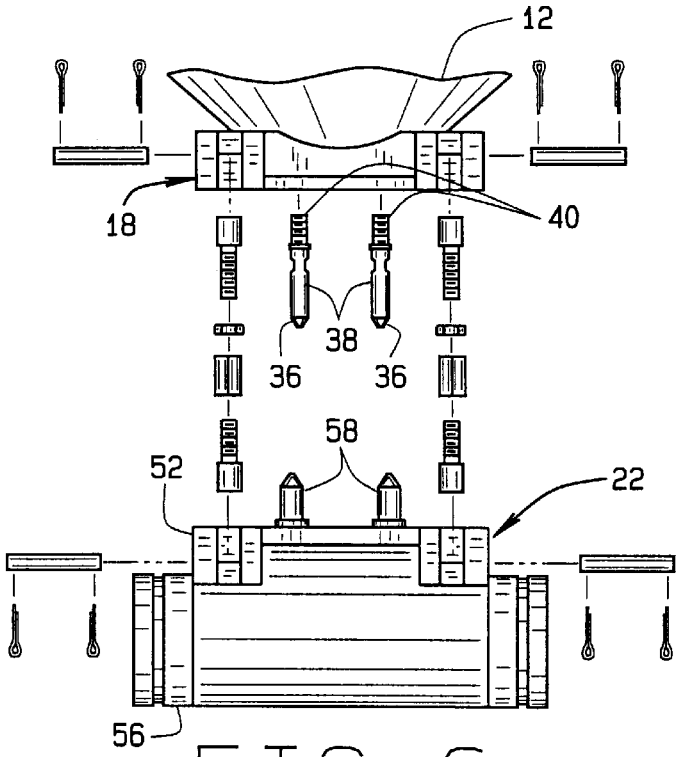
FIG. 6 is an exploded back plan view of the swing-away hopper tee assembly (without the butterfly valve)
Figure 7:
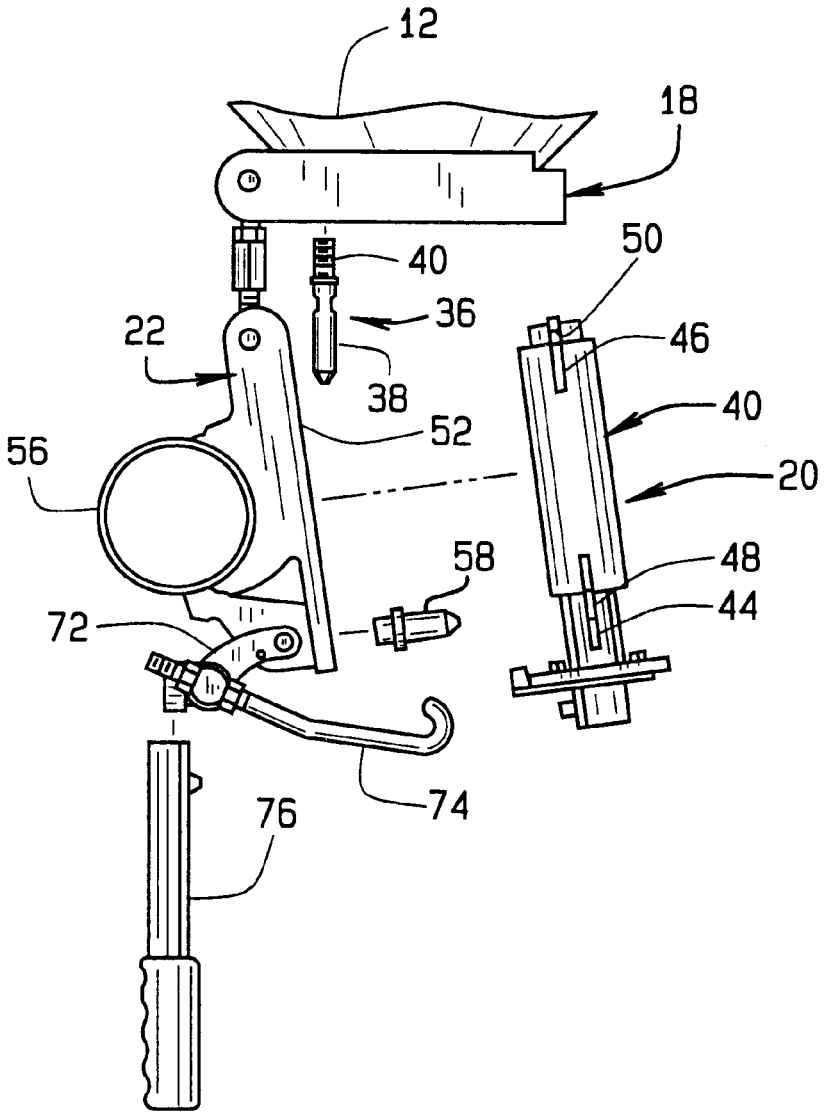
FIG. 7 is an exploded side elevational view of the swing-away hopper tee assembly.

The swing-away tee assembly 10 is movable between a closed position, as shown in FIGS. 1 and 2, and an opened position, as shown in FIGS. 3, 4, and 7. A camming lock assembly 70, as is disclosed in my above noted U.S. Pat. No. 5,842,681, secures the tee assembly 10 in the closed position. Briefly, the lock assembly includes a camming element 72 which carries a pair of hooks 74. The hooks are removably received in an opening in the front of the mounting frame 18, as seen in FIG. 1. The camming element is raised and lowered by a removable handle or lever 76. As discussed in my U.S. Pat. No. 5,842,681, the lever 76 is used to move the camming element 72 between a raised position in which the hooks 74 can be removed from the mounting frame 18 to allow the hopper tee assembly to move to its opened position and a lowered position in which the hooks 74 hold the hopper tee assembly 10 closed, as seen in FIG. 1.

As noted above, the hopper tee assembly 10 is removably secured to the hopper flange 14 by the rear positioning pins 36. Hence, the complete assembly 10 can be mounted to, or removed from, the hopper 12 using the two pins 36. This makes mounting of the hopper 10 assembly to the hopper 12 simple and quick.

Additionally, the hopper tee assembly 10 allows for easy retrofitting of existing hoppers with swing-away tees of the present invention. To retrofit an existing hopper, the permanently secured hopper tee is removed from the hopper. The flange 14 is then added to the discharge end of the hopper (such as by welding). The hopper tee of the present invention can then be quickly installed, as noted above. If the hopper already has the flange 14, the hopper tee assembly 10 is quickly and easily mounted to the hopper simply by sliding the mounting frame 18 over the flange 14, such that the flange 14 is received in the channel 32. The pins 36 are then passed through the channel wall and the flange to hold the hopper tee assembly in place on the flange. Hence, when the hopper includes the flange 14, no cutting or welding is required to secure the hopper tee assembly 10 to the hopper.

As various changes could be made in the above constructions without departing from the scope of the invention, it is intended that all matter contained in the above description or shown in the accompanying drawings shall be interpreted as illustrative and not in a limiting sense. For example, the mounting frame bottom wall could be increased in size to also include an opening in alignment with the hopper flange opening, such that the rear positioning pin passes through the bottom wall opening. Additionally, such a bottom wall opening could be used in place of the top wall opening. In this instance, the flange openings would then be threaded to accept the threaded end of the pins 36. Additionally, the butterfly valve assembly could be made to be integral with either the tee assembly or the mounting flange. These examples are merely illustrative.

What is claimed is:

1. In a swing-away hopper tee comprising a mounting frame, tee assembly, and a valve assembly; the improvement comprising said mounting frame; said mounting frame comprising a bottom wall, a top wall spaced from said bottom wall, and an outer wall extending between said top and bottom walls; said walls defining a channel sized and shaped to receive a flange of a hopper; said channel including a fastener which cooperates with said hopper flange to removably secure said mounting frame to said hopper.

2. The improvement of claim 1 wherein one of said mounting frame top and bottom walls includes an opening through which a pin extends; said pin securing said mounting frame to said hopper flange.

3. The improvement of claim 2 wherein said opening is in said mounting frame top wall; said mounting frame bottom wall being sized to expose said opening in said mounting frame top wall.

4. A hopper assembly including a hopper and a swing-away hopper tee assembly removably mounted to said hopper;

said hopper including a discharge end and a flange adjacent said hopper discharge end; said flange having at least one opening therein;

said swing away hopper tee assembly including a mounting frame, a tee assembly, and a valve assembly; said mounting frame comprising a bottom wall, a top wall spaced from said bottom wall, and an outer wall extending between said top and bottom walls; said walls defining a channel corresponding in shape to said hopper flange and sized to receive said flange of a hopper; said channel including an opening through at least one of said top and bottom walls alignable with said hopper flange opening; said assembly further including a fastener which passes through said hopper flange opening and said channel wall opening to removably secure said mounting frame to said hopper.

5. The hopper of claim 4 wherein said fastener includes a positioning pin; said positioning pin engaging said butterfly valve assembly to position said butterfly valve between said mounting frame and said tee assembly.

6. The hopper of claim 4 wherein said channel wall opening is in said mounting frame top wall; said mounting frame bottom wall being sized to expose said hopper flange opening when said mounting frame is positioned on said hopper flange.

7. A method of mounting a hopper tee assembly to a discharge hopper; discharge hopper having a flange adjacent a discharge end of said hopper; said flange having at least one hole therein; said hopper tee assembly including a mounting frame; said mounting frame defining a channel corresponding in shape to said hopper flange and sized to receive said flange of a hopper; said channel being defined by at least an upper wall and a lower wall, and including a wall opening in at least one of said upper and lower walls; said method comprising sliding said mounting frame onto said flange until said mounting frame opening is aligned with said flange opening; and passing a fastener through said mounting frame opening and said flange opening to removably secure said mounting frame to said hopper flange.

8. The method of claim 7 wherein said fastener is a positioning pin.

9. The method of claim 7 wherein said channel wall opening is in said mounting frame top wall; said mounting frame bottom wall being sized to expose said hopper flange opening when said mounting frame is positioned on said hopper flange.

* * * * *